US006311521B1

(12) United States Patent
Mifune et al.

(10) Patent No.: US 6,311,521 B1
(45) Date of Patent: Nov. 6, 2001

(54) PROCESS FOR PRODUCING FLAME REACTION MEMBERS FOR BURNERS

(75) Inventors: Hideo Mifune; Masato Seki, both of Shizuoka-ken (JP)

(73) Assignee: Tokai Corporation, Shizuoka-ken (JP)

( * ) Notice: Subject to any disclaimer, the term of this patent is extended or adjusted under 35 U.S.C. 154(b) by 0 days.

(21) Appl. No.: 09/111,607

(22) Filed: Jul. 7, 1998

(30) Foreign Application Priority Data

Jul. 8, 1997 (JP) ..... 9-182234

(51) Int. Cl.[7] ..... C03B 19/06

(52) U.S. Cl. ..... 65/17.4; 65/17.2; 65/17.3; 65/17.6; 427/226; 427/223; 427/224; 431/126; 431/4; 431/268; 431/255

(58) Field of Search ..... 65/17.2, 17.3, 65/17.4, 17.6; 427/226, 223, 224; 431/126, 4, 268, 255

(56) References Cited

U.S. PATENT DOCUMENTS 5,246,475 * 9/1993 Edagawa ..... 65/18.2
5,622,750 * 4/1997 Killian ..... 427/163.2
5,743,724 * 4/1998 Mifune ..... 431/126
5,817,160 * 10/1998 Nagpal ..... 65/17.3

* cited by examiner

*Primary Examiner*—Stanley S. Silverman
*Assistant Examiner*—Mark Halpern
(74) *Attorney, Agent, or Firm*—BakerBotts, LLP

(57) ABSTRACT

A raw material mixture, which has a glass composition containing a salt or an oxide of a flame reaction metal, is heated, and an intermediate base material, in which the salt of the flame reaction metal, or the like, has been thermally decomposed and which is in a temporary sintered state or a fused glass state, is thereby formed. The intermediate base material is ground, and a ground material is thereby obtained. The ground material is mixed together with a liquid and, optionally, a binder, and a viscous flame reaction material is thereby formed. The viscous flame reaction material is supported on a substrate and heated to a temperature, which is not lower than a vitrification melting temperature of the viscous flame reaction material. In this manner, the flame reaction material is fusion bonded to the substrate. Generation of a thermal decomposition gas in the baking step is thus restricted, and the carrying of the flame reaction material on the substrate is carried out appropriately.

10 Claims, 12 Drawing Sheets

SiO2
Na2CO3
Na2CO3
GLASS FRIT

SiO2
Na2O
Na2O
GLASS FRIT

SiO2
NaCl
NaCl
GLASS FRIT
VITRIFIED PERFECTLY
VITRIFIED APPROXIMATELY

SiO2
NaOH
NaOH
GLASS FRIT

SiO2
Na2SO4
Na2SO4
GLASS FRIT

SiO2
NaHCO3
NaHCO3
GLASS FRIT

SiO2
Na2CO3
P
GLASS FRIT

SiO2
Na2O
GLASS FRIT

SiO2
NaCl
GLASS FRIT
OPTIMUM RANGE
APPROPRIATE RANGE

SiO2
NaOH
GLASS FRIT

SiO2
Na2SO4
GLASS FRIT

SiO2
NaHCO3
GLASS FRIT

SiO2
Li2CO3
Al2O3
Li2CO3

SiO2
Li2O
Al2O3
Li2O

SiO2
LiCl
Al2O3
LiCl
VITRIFIED PERFECTLY
VITRIFIED APPROXIMATELY

SiO2
LiOH
Al2O3
LiOH

SiO2
Li2SO4
Al2O3
Li2SO4

SiO2
Li2CO3
P1
Al2O3
Li2CO3

SiO2
Li2O
Al2O3
Li2O
OPTIMUM RANGE
APPROPRIATE RANGE

SiO2
LiCl
Al2O3
LiCl

SiO2
LiOH
Al2O3
LiOH

SiO2
Li2SO4
Al2O3
Li2SO4

VITRIFIED PERFECTLY

VITRIFIED APPROXIMATELY

VITRIFIED PERFECTLY

VITRIFIED APPROXIMATELY

B2O3
CuO
P1
Al2O3
CuO

B2O3
Cu2O
Al2O3
Cu2O
OPTIMUM RANGE
APPROPRIATE RANGE

B2O3
CuCl2
Al2O3
CuCl2

B2O3
CuCl
Al2O3
CuCl

OPTIMUM RANGE

APPROPRIATE RANGE

PROCESS FOR PRODUCING FLAME REACTION MEMBERS FOR BURNERS

BACKGROUND OF THE INVENTION

1. Field of the Invention

This invention relates to a process for producing a flame reaction member for burners, which is to be located in a gas combustion appliance, such as a gas lighter for smoker's requisites, a lighter, or a torch, and which undergoes a flame reaction and colors a gas flame produced by gas combustion with a burner of the gas combustion appliance. This invention also relates to a flame reaction base material for use in the process for producing a flame reaction member for burners.

2. Description of the Prior Art

In combustion appliances, such as candles, lighters, and torches, combustion flames have heretofore been often colored with flame reaction materials. The coloring of combustion flames is effective to enhance the aesthetic and decorative values of the combustion flames. Also, it is effective for safety to impart a color to colorless combustion flames such that they can be identified.

Flame reactions with the flame reaction materials utilize a phenomenon such that, when salts of alkali metals, alkaline earth metals, and the like, are heated heavily in flames generated by burners, colors inherent to the respective metals can be formed in the flames In order to color combustion flames, salts of metal elements capable of forming required flame colors may be interposed in the combustion flames.

For example, in order to color the flames produced by candles, a metal stearate serving as a flame reaction material is mixed into a wax material. During the combustion of the candle, simultaneously with the volatilization of the molten wax material, the flame reaction material is volatilized and is caused to form a color by being heated in the flame.

In order to color the flames produced by other combustion appliances, an aqueous solution of a water-soluble inorganic salt is sprayed into the flame. Alternatively, a carrier is impregnated with an aqueous solution of a water-soluble inorganic salt, dried, and then located at a high temperature portion of the flame. In particular, in the cases of gas lighters, a coiled nichrome wire having been coated with a flame reaction material is located in the vicinity of the fire outlet of the gas lighter, and a colored flame is thereby obtained.

Also, a process for producing a flame reaction member has theretofore been known, wherein a flame reaction material containing a flame reaction agent is adhered to a wire-shaped substrate by dipping, or the like, the substrate, to which the flame reaction material has been adhered, is heated, a binder, or the like, contained in the flame reaction material is thereby removed, and the substrate is baked such that the flame reaction material may be supported on the substrate.

In a gas combustion appliances provided with burners, in which primary air is mixed into a fuel gas, in cases where a flame is to be colored by the utilization of a flame reaction as described above, it is required that a flame reaction member can steadily undergo the flame reaction in order to provide a stable colored flame, has a good heat durability with respect to repeated combustion, and has a long service life. However, with the flame reaction member, which is formed by merely adhering a flame reaction material onto a substrate by baking in the manner described above, such requirements cannot be satisfied sufficiently.

Specifically, a viscous liquid-like flame reaction material may be prepared by mixing a flame reaction agent, which is constituted of a salt of an alkali metal, a salt of an alkaline earth metal, or the like, capable of undergoing a flame reaction, and a binder, or the like. The viscous liquid-like flame reaction material may then be adhered to a loop- or coil-shaped substrate by a coating process or a dipping process. The substrate, to which the flame reaction material has been adhered, may then be baked, and a flame reaction member may thereby be formed. The flame reaction member may be located at a fire outlet of a gas combustion appliance, such as a gas lighter. In such cases, the problems occur in that, if the flame reaction material is chemically unstable, it will deteriorate when being left to stand for a long period of time, and a desired flame reaction cannot be obtained any more. Also, if the heat-resistance strength is low, the flame reaction material will crack due to rapid heating and quenching cycles due to lighting and extinguishment during use, the cracked portions will come off the substrate, and therefore several portions of the flame cannot be colored.

Also, when a flame reaction material colors a flame, the flame reaction metal is evaporated into the flame and exhausted due to heating with the gas flame. Therefore, the problems occur in that, as the flame reaction material is used, the amount of the flame reaction metal evaporated becomes small, and the formed color becomes unstable or pale. Thus the flame reaction material cannot be used repeatedly or for a long time, and its service life is short. Further, depending upon the composition of the flame reaction material, the problems occur in that the activity of the flame reaction is low, and therefore a long time is required from the heating to the color formation. In particular, in the cases of gas lighters, it is necessary that the time required from the lighting to the occurrence of the color formation of the flame with the flame reaction is as short as possible. Furthermore, a good durability with respect to repeated heating and quenching is required.

As described above, as characteristics of the flame reaction material, it is required that the flame reaction material is firmly supported on the substrate, that the flame reaction material is chemically stable and does not deteriorate even when being left to stand for a long period of time in air, and that the flame reaction material undergoes little exhaustion during the repeated use, remains on the substrate continuously to always undergo the flame reaction, and thus has a long service life.

Accordingly, in order to satisfy the requirements described above, several processes for producing a flame reaction member for burners have been proposed in, for example, U.S. Pat. No. 5,743,724 and Japanese Unexamined Patent Publication No. 8(1996)-296849. In the proposed processes, an oxide or a salt of a metal capable of undergoing a flame reaction is employed as a flame reaction agent. A mixture of the flame reaction agent and an appropriate amount of a metal oxide, which is capable of being mixed and fused together with the flame reaction agent and vitrified without adversely affecting the desired flame reaction, is adhered to a substrate by baking. Alternatively, in order for the flame reaction agent to be firmly fixed to the substrate, a low-melting-temperature glass material is added to the aforesaid mixture of the flame reaction agent and the metal oxide, which is capable of being mixed and fused together with the flame reaction agent, and the resulting mixture is adhered to the substrate by baking. In this manner, a flame reaction member for burners is produced.

However, in cases where a vitreous flame reaction material is to be fusion bonded to the substrate, if an oxide of a flame reaction metal is employed as a flame reaction agent in the flame reaction material, no problems will particularly occur. However, if a salt, such as a carbonate, a sulfate, or a nitrate, of a flame reaction metal is employed, fusion bonding of the flame reaction material to the substrate cannot be carried out sufficiently. As a result, the problems occur in that the amount of the flame reaction material carried on the substrate becomes insufficient, and color forming characteristics and durability cannot be kept good.

Specifically, a vitreous flame reaction material, which contains a flame reaction constituent, may be mixed with a liquid, such as water, and a binder, when necessary, and a viscous liquid may thereby be prepared. The thus prepared viscous liquid may then be supported on a substrate, heated, and baked. In such cases, a certain kind of salt of the flame reaction metal described above is converted into the oxide of the flame reaction metal due to thermal decomposition, and the resulting oxide of the flame reaction metal is fused and vitrified together with the other metal oxides. A different kind of salt of the flame reaction metal, which has a thermal decomposition temperature higher than the vitrification melting temperature, is fused and mixed in the vitrified melt of the other constituents. Also, the liquid, such as water, and the binder, such as a sizing agent, which were added in order to prepare the viscous liquid containing the powdered flame reaction material such that the viscous liquid may be supported on the substrate by coating or dipping, are evaporated and burned off due to the heating for fusion bonding. Thereafter, the powdered flame reaction material is fixed with a weak fixing force to the substrate. When the flame reaction material is heated to a temperature higher than the melting temperature, fused and vitrified, the flame reaction material is firmly fixed to the substrate. However, during the temperature increasing step prior to the fusion and vitrification, if gases are produced quickly due to the thermal decomposition of the salts of the flame reaction metal and other compounds, foaming occurs in the flame reaction material, which is being bonded weakly to the substrate prior to the fusion and vitrification, due to the generation of the thermal decomposition gases. As a result, the flame reaction material becomes cracked and scattered, and the carrying of the flame reaction material on the substrate cannot be carried out appropriately.

SUMMARY OF THE INVENTION

The primary object of the present invention is to provide a process for producing a flame reaction member for burners, wherein generation of the thermal decomposition gases in a baking step is restricted, and the carrying of a flame reaction material on a substrate is carried out appropriately.

Another object of the present invention is to provide a flame reaction base material for use in the process for producing a flame reaction member for burners.

The present invention provides a first process for producing a flame reaction member for burners, comprising the steps of:

i) heating and increasing a temperature of a raw material mixture which has a glass composition containing a salt or an oxide of a flame reaction metal to form an intermediate base material in which the salt of the flame reaction metal or the like has been thermally decomposed and which is in a temporary sintered state or a fused glass state, ii) grinding the intermediate base material to produce a ground material, iii) mixing the ground material together with a liquid and, optionally, a binder to form a viscous flame reaction material, iv) applying the viscous flame reaction material to a substrate, and v) heating the viscous flame reaction material to a temperature, which is not lower than a vitrification melting temperature of the viscous flame reaction material to fusion bond the flame reaction material to the substrate.

In the first process for producing a flame reaction member for burners in accordance with the present invention, a low-melting-temperature glass material should preferably be added to the ground material of the intermediate base material. In such cases, the flame reaction material can be fusion bonded more firmly to the substrate.

The present invention also provides a flame reaction base material, characterized by being prepared by:

heating and increasing a temperature of a raw material mixture, which has a glass composition containing a salt or an oxide of a flame reaction metal thereby forming an intermediate base material in which the salt or oxide of the flame reaction metal has been thermally decomposed and which is in a temporary sintered state or a fused glass state, and grinding the intermediate base material.

The present invention further provides a second process for producing a flame reaction member for burners, comprising the steps of:

i) mixing a raw material mixture which has a glass composition containing a salt or an oxide of a flame reaction metal, together with a liquid and, optionally, a binder to form a viscous flame reaction material, ii) applying the viscous flame reaction material to a substrate, and iii) heating the viscous flame reaction material to a temperature which is not lower than a vitrification melting temperature of the flame reaction material to fusion bond the flame reaction material to the substrate, wherein the raw material mixture contains a compound which has a thermal decomposition temperature not higher than the vitrification melting temperature of the flame reaction material, and a rate of temperature increase in the vicinity of the thermal decomposition temperature is set to be low enough to avoid scattering of the flame reaction material in the step of heating the viscous flame reaction material.

In the second process for producing a flame reaction member for burners in accordance with the present invention, a rate of temperature increase in the vicinity of an evaporation temperature of the liquid or in the vicinity of a burn-off temperature of the binder may also be set to be low enough to avoid scattering of the flame reaction material in the step of heating the viscous liquid-like flame reaction material.

Also, in the second process for producing a flame reaction member for burners in accordance with the present invention, the salt or the oxide of the flame reaction metal may have a thermal decomposition temperature, which is not higher than the vitrification melting temperature of the flame reaction material, and a melting point, which is not lower than the vitrification melting temperature of the flame reaction material.

The present invention still further provides a third process for producing a flame reaction member for burners, comprising the steps of:

i) mixing a raw material mixture which has a glass composition containing a salt of a flame reaction metal together with a liquid and, optionally, a binder to form a viscous liquid-like flame reaction material, ii) applying the viscous liquid-like flame reaction material to a substrate, and iii) heating the viscous liquid-like flame reaction material to a temperature which is not lower than a vitrification melting temperature of the flame reaction material to fusion bond the flame reaction material to the substrate, wherein compounds which are contained in the raw material mixture have a thermal decomposition temperature not lower than the vitrification melting temperature of the flame reaction material and are mixed in a fused state in the flame reaction material when the flame reaction material is fused and vitrified.

In the third process for producing a flame reaction member for burners in accordance with the present invention, the salt of the flame reaction metal may have a thermal decomposition temperature which is not lower than the vitrification melting temperature of the flame reaction material and a melting point which is not higher than the vitrification melting temperature of the flame reaction material.

In the first, second, and third processes for producing a flame reaction member for burners in accordance with the present invention, a low-melting-temperature glass material should preferably be blended in the raw material mixture. In such cases, the flame reaction material can be fusion bonded more firmly to the substrate.

The flame reaction materials of the flame reaction members produced with the processes in accordance with the present invention are constituted of the oxide which is formed by the thermal decomposition of the salt of an alkali metal, the salt of an alkaline earth metal, or the like, and which is fused and vitrified together with other metal oxides, or is constituted of the aforesaid salt, which is fused and mixed in the flame reaction material. The flame reaction materials may further contain the low-melting-temperature glass material for enhancing the adhesion of the flame reaction member to the substrate. In cases where the flame reaction member is located in a burner, the oxide of the flame reaction metal or the salt of the flame reaction metal contained in the vitrified flame reaction material is reduced or thermally decomposed in a burner flame and liberates the flame reaction metal atoms. The flame reaction metal atoms form a color in a high temperature portion of the burner flame. In this manner, the flame reaction occurs and the flame is colored.

With the first process for producing a flame reaction member for burners in accordance with the present invention the raw material mixture, which has the glass composition containing the salt or the oxide of the flame reaction metal is heated to form the intermediate base material, in which the salt of the flame reaction metal, or the like, has been thermally decomposed. The intermediate base material is ground, and the ground material is thereby obtained. The ground material is mixed together with the liquid and, optionally, the binder, and the viscous flame reaction material is thereby formed. The viscous flame reaction material is supported on the substrate and heated. In this manner, the flame reaction material is fusion bonded to the substrate. Therefore, no thermal decomposition gas is generated in the temperature increasing step for the fusion bonding. Accordingly, the problems resulting form the amount of the flame reaction material carried on the substrate being decreased due to the scattering of the flame reaction material accompanying the generation of the decomposition gas in the temperature range, which is prior to the fusion and vitrification and in which the powdered flame reaction material is being fixed with a weak bonding force to the substrate can be prevented. As a result, the fusion bonding can be carried out appropriately, the rate of temperature increase during the fusion bonding can be set to be high, and the productivity can be enhanced.

The flame reaction base material in accordance with the present invention is prepared by heating and increasing the temperature of the raw material mixture which has the glass composition containing the salt or the oxide of the flame reaction metal, thereby forming the intermediate base material, which is in the temporary sintered state or the fused glass state, and grinding the intermediate base material. With the flame reaction base material in accordance with the present invention, the flame reaction member for burners, which has good quality, can be produced easily by mixing the flame reaction base material with a liquid and, optionally, a binder, thereby forming a viscous flame reaction material, applying the viscous flame reaction material to a substrate, heating the viscous flame reaction material to a temperature, which is not lower than the vitrification melting temperature of the viscous flame reaction material, and thereby fusion bonding the flame reaction material to the substrate.

With the second process for producing a flame reaction member for burners in accordance with the present invention, the raw material mixture which has the glass composition containing the salt or the oxide of the flame reaction metal is mixed together with the liquid and, optionally, the binder to form the viscous flame reaction material. The viscous flame reaction material is supported on the substrate and heated, and the flame reaction material is thereby fusion bonded to the substrate. In the second process, the raw material mixture contains the compound which has a thermal decomposition temperature not higher than the vitrification melting temperature of the flame reaction material, and the rate of temperature increase in the vicinity of the thermal decomposition temperature is set to be low, such that the rate of generation of a decomposition gas may become low, in the step of heating the viscous liquid-like flame reaction material. Therefore, even if a gas is generated when the bonding force of the powdered flame reaction material to the substrate is weak in the temperature increasing step, since the rate of temperature increase is low, the powdered flame reaction material will not be scattered due to the gas generation and can be supported on the substrate. With the subsequent temperature increase, the flame reaction material can be fusion bonded appropriately to the substrate. In such case, even if the melting temperature of the salt or the oxide of the flame reaction metal is not lower than the vitrification melting temperature, the fusion bonding of the flame reaction material can be carried out appropriately.

In the second process for producing a flame reaction member for burners in accordance with the present invention the rate of temperature increase in the vicinity of the evaporation temperature of the liquid, which is contained in the viscous liquid-like flame reaction material or in the vicinity of the burn-off temperature of the binder may also be set to be low in the step of heating the viscous liquid-like flame reaction material. In such cases, the fusion bonding of the flame reaction material can be carried out more appropriately.

With the third process for producing a flame reaction member for burners in accordance with the present invention the raw material mixture, which has the glass composition containing the salt of the flame reaction metal, is mixed together with the liquid and, optionally, the binder to form and the viscous flame reaction material. The viscous flame reaction material is supported on the substrate and heated, and the flame reaction material is thereby fusion bonded to the substrate. In the third process the compounds which are contained in the raw material mixture have a thermal decomposition temperature not lower than the vitrification melting temperature of the flame reaction material and are mixed in the fused state in the flame reaction material when the flame reaction material is fused and vitrified. Therefore, no thermal decomposition gas is generated in the step of increasing the temperature to the fusion and vitrification, and the problems resulting from the powdered flame reaction material, which is in the weakly bonded state prior to the fusion, being scattered due to gas generation can be prevented. Accordingly, the fusion bonding of the flame reaction material to the substrate can be carried out appropriately. Also, since the rate of temperature increase can be set to be high, the productivity can be enhanced. In such case, even if the melting temperature of the salt of the flame reaction metal is not higher than the vitrification melting temperature, the fusion bonding of the flame reaction material can be carried out appropriately.

With the first, second, and third processes for producing a flame reaction member for burners in accordance with the present invention, wherein the low-melting-temperature glass material is blended in the raw material mixture or the intermediate base material, the vitrification can be carried out more appropriately, and the flame reaction material can be fusion bonded more firmly to the substrate.

DETAILED DESCRIPTION OF THE INVENTION

Figure 1A:
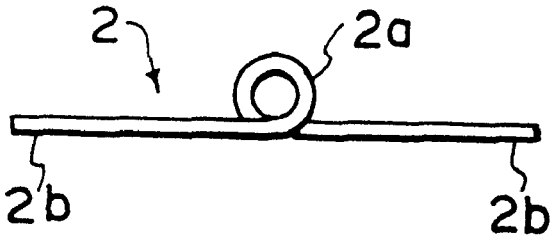
FIGS. 1A, 1B, and 1C are front views showing steps for producing a flame reaction member for burners in an embodiment of the process in accordance with the present invention.

The present invention will hereinbelow be described in further detail.

Basically, in the process for producing a flame reaction member for burners in accordance with the present invention, a salt or an oxide of a flame reaction metal, a metal oxide or a metal salt, which is capable of being fused together with the salt or the oxide of the flame reaction metal and vitrified, and optionally a low-melting-temperature glass material are employed as the raw materials for the flame reaction material. A liquid, such as water, and optionally a binder are mixed with the flame reaction composition, and a viscous liquid-like flame reaction material is thereby formed. The viscous liquid-like flame reaction material is supported on a substrate by coating or dipping. Thereafter, the viscous liquid-like flame reaction material is heated to a temperature, which is not lower than the vitrification melting temperature of the flame reaction material. The flame reaction material is thus vitrified and fusion bonded to the substrate. A decrease in the characteristics, with which the flame reaction material is carried on the substrate, due to gas generation is prevented by setting the temperature increase conditions or modifying the production steps in accordance with thermal decomposition temperatures of the metal salt, which is capable of undergoing a flame reaction, and other compounds contained in the composition.

In the step of adhering the flame reaction material described above to the substrate by baking, the temperature of the flame reaction material is increased to a temperature, at which the composition can be vitrified and fusion bonded to the substrate. In such cases, at temperatures falling within the range of 100° C. to 200° C., the liquid, such as water, evaporates, and the binder is burned off after fixing the composition of the powdered flame reaction material to the substrate. Thereafter, the powdered flame reaction material is supported on the substrate in a weakly bonded state. When the temperature is increased even further from such a state, vitrification is begun at a temperature of approximately 800° C., and the fused compounds are drawn together by their surface tension. In this manner, the flame reaction material is fusion bonded appropriately to the substrate.

The metal oxide or the metal salt, which is mixed with the salt or the oxide of the metal capable of undergoing a flame reaction, is selected from materials, which do not adversely affect the flame reaction and can be vitrified at temperatures falling within a predetermined temperature range (approximately 800° C.).

As the salt of the flame reaction metal, one of various compounds of each flame reaction metal corresponding to the desired color formation may be utilized. Ordinarily, the flame reaction metal salt is selected from the compounds having the characteristics such that, in the temperature increasing step, the compounds can be thermally decomposed and the bases can be substituted by oxygen into oxides and vitrified. In such cases, a decomposition gas is generated. Alternatively, the flame reaction metal salt may be selected from the compounds having the characteristics such that, in the temperature increasing step, the compounds can be fused and mixed in the flame reaction material glass.

As the flame reaction metal capable of undergoing a flame reaction, an alkali metal or an alkaline earth metal is employed. Colors formed by the metal atoms in a high-temperature flame are already known. Ordinarily, Na is employed for the formation of an orange-yellow color, Li is employed for the formation of a red color, and Cu is employed for the formation of a green color. Examples of salt compounds of the flame reaction metals and their thermal decomposition reactions will be described below. The decomposition gas, which is generated due to the reaction, will be indicated by the mark ↑.

Examples of the salt compounds of Na, which is the flame reaction metal capable of forming an orange-yellow color, include those shown below.

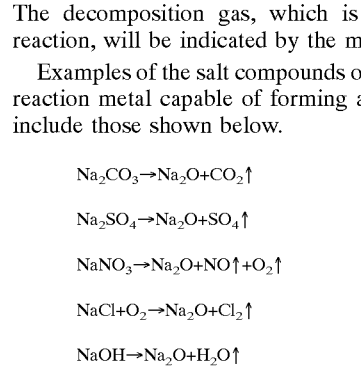

$$Na_2CO_3 \rightarrow Na_2O + CO_2\uparrow$$

$$Na_2SO_4 \rightarrow Na_2O + SO_4\uparrow$$

$$NaNO_3 \rightarrow Na_2O + NO\uparrow + O_2\uparrow$$

$$NaCl + O_2 \rightarrow Na_2O + Cl_2\uparrow$$

$$NaOH \rightarrow Na_2O + H_2O\uparrow$$

Examples of the salt compounds of Li, which is the flame reaction metal capable of forming a red color, include those shown below.

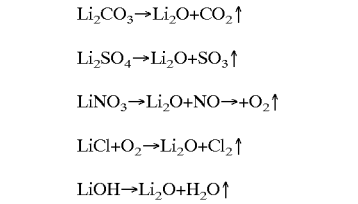

$$Li_2CO_3 \rightarrow Li_2O + CO_2\uparrow$$

$$Li_2SO_4 \rightarrow Li_2O + SO_3\uparrow$$

$$LiNO_3 \rightarrow Li_2O + NO \rightarrow + O_2\uparrow$$

$$LiCl + O_2 \rightarrow Li_2O + Cl_2\uparrow$$

$$LiOH \rightarrow Li_2O + H_2O\uparrow$$

Examples of the salt compounds of Cu, which is the flame reaction metal capable of forming a green color, include those shown below.

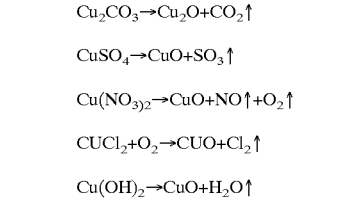

$$Cu_2CO_3 \rightarrow Cu_2O + CO_2\uparrow$$

$$CuSO_4 \rightarrow CuO + SO_3\uparrow$$

$$Cu(NO_{3)2} \rightarrow CuO + NO\uparrow + O_2\uparrow$$

$$CUCl_2 + O_2 \rightarrow CUO + Cl_2\uparrow$$

$$Cu(OH)_2 \rightarrow CuO + H_2O\uparrow$$

In the reactions shown above, the salts of the flame reaction metals are converted into oxides. The thermal decomposition temperature, at which the reaction can occur, varies for different metal salts. For example, as for the sodium salts, measurements with a thermal analyzer revealed that thermal decomposition occurs at 338.6° C. for $Na_2CO_3$, approximately 380° C. for $NaNO_3$, and 171° C. for NaOH. As for $Na_2SO_4$, crystal modification occurs at 222° C. and 276° C., thermal decomposition does not occur at temperatures, which are not higher than the vitrification temperature. Also, as for NaCl, thermal decomposition does not occur at temperatures, which are not higher than the vitrification temperature. The lithium slats and copper salts described above have the same thermal decomposition temperature characteristics.

The process for producing a flame reaction member for burners in accordance with the present invention is embodied in accordance with the thermal decomposition temperatures of the salt of the flame reaction metal and other compounds contained in the composition.

In a first embodiment, a raw material mixture, which has a glass composition containing a salt or an oxide of a flame reaction metal, is heated, and an intermediate base material, in which a thermally decomposable compound contained in the raw material mixture, such as the salt of the flame reaction metal, has been thermally decomposed and which is in a temporary sintered state or a fused glass state, is thereby formed. The intermediate base material is ground, and a flame reaction base material constituted of the thus ground material is thereby obtained. The flame reaction base material is mixed together with a liquid and, optionally, a binder, and a viscous liquid-like flame reaction material is thereby formed. The viscous liquid-like flame reaction material is supported on a substrate and heated to a temperature, which is not lower than a vitrification melting temperature of the viscous liquid-like flame reaction material. In this manner, the flame reaction material is fusion bonded to the substrate. In this embodiment, no limitation is imposed upon the kind of the salt of the flame reaction metal and the kinds of other compounds contained in the composition. However, this embodiment should preferably be applied to cases wherein a compound, which has a thermal decomposition temperature lower than the vitrification melting temperature of the flame reaction material, e.g. $Na_2CO_3$, $NaHCO_3$, $NaNO_3$, or $Cu_2CO_3$, is selected.

With the first embodiment described above, the raw material mixture is heated and thermally decomposed previously, and a decomposition gas is thereby generated previously. Therefore, when the viscous liquid-like flame reaction material is fusion bonded to the substrate, generation of a decomposition gas does not occur, and the heating can be carried out quickly.

In a second embodiment, a raw material mixture, which has a glass composition containing a salt or an oxide of a flame reaction metal, is mixed together with a liquid and, optionally, a binder, and a viscous liquid-like flame reaction material is thereby formed. The viscous liquid-like flame reaction material is supported on a substrate and heated to a temperature, which is not lower than a vitrification melting temperature of the flame reaction material. In this manner, the flame reaction material is fusion bonded to the substrate. In the second embodiment, the raw material mixture contains a compound, which has a thermal decomposition temperature not higher than the vitrification melting temperature of the flame reaction material. Also, the rate of temperature increase in the vicinity of the thermal decomposition temperature is set to be low in the step of heating the viscous liquid-like flame reaction material. This embodiment should preferably be applied to cases where the salt of the flame reaction metal, such as $Na_2CO_3$, $NaNO_3$, or NaOH, is employed. Also, the rate of temperature increase in the vicinity of the evaporation temperature of the liquid or in the vicinity of the burn-off temperature of the binder may also be set to be low in the step of heating the viscous liquid-like flame reaction material. Further, the salt or the oxide of the flame reaction metal may have a thermal decomposition temperature, which is not higher than the vitrification melting temperature of the flame reaction material, and a melting point, which is not lower than the vitrification melting temperature of the flame reaction material.

In the second embodiment, a decomposition gas is generated at an intermediate point in the temperature increasing step. However, since the rate of temperature increase is set to be low, the rate of generation of a decomposition gas becomes low. Therefore, even if the flame reaction material is being bonded with a weak bonding force to the substrate, the flame reaction material will not be scattered due to the gas generation and can be fusion bonded to the substrate. In cases where the rate of temperature increase is set to be low when the liquid or the binder is volatilized from the viscous liquid-like flame reaction material, the fusion bonding of the flame reaction material can be carried out more appropriately without the flame reaction material being scattered.

In a third embodiment, a raw material mixture, which has a glass composition containing a salt of a flame reaction metal, is mixed together with a liquid and, optionally, a binder, and a viscous liquid-like flame reaction material is thereby formed. The viscous liquid-like flame reaction material is supported on a substrate and heated to a temperature, which is not lower than a vitrification melting temperature of the flame reaction material. In this manner, the flame reaction material is fusion bonded to the substrate. In the third embodiment, compounds, which are contained in the raw material mixture, have a thermal decomposition temperature not lower than the vitrification melting temperature of the flame reaction material and are mixed in a fused state in the glass composition of the flame reaction material by being converted into oxides or without being converted into oxides when the flame reaction material is fused and vitrified. This embodiment is applied to cases wherein the salt of the flame reaction metal, which has a comparatively high thermal decomposition temperature of at least approximately 800° C., such as $Na_2SO_4$, NaCl, $Li_2SO_4$, LiCl, or $CuCl_2$, is employed.

In the third embodiment, the salt of the flame reaction metal may have a thermal decomposition temperature, which is not lower than the vitrification melting temperature of the flame reaction material, and a melting point, which is not higher than the vitrification melting temperature of the flame reaction material. Examples of such salts of flame reaction metals include $Li_2CO_3$, which has a thermal decomposition temperature of 1,500° C. and a melting point of 726° C., and LiOH, which has a thermal decomposition temperature of 924° C. and a melting point of 450° C. These salts of the flame reaction metals are fused at temperatures not higher than the vitrification temperature and are mixed in a fused state in the flame reaction glass.

With the third embodiment, when the flame reaction material is fused and vitrified, the salt of the flame reaction metal is decomposed and vitrified, or is fused and mixed in the flame reaction glass without being decomposed. Generation of a decomposition gas does not occur in the temperature increasing step before the flame reaction material is fused and vitrified. Therefore, the flame reaction material can be heated quickly.

In the first, second, and third embodiments described above, in cases where a low-melting-temperature glass material is blended in the raw material mixture, the flame reaction material can be fusion bonded more firmly to the substrate. The same effects can be obtained when the low-melting-temperature glass material is blended in the intermediate base material in the first embodiment described above.

Figure 1B:
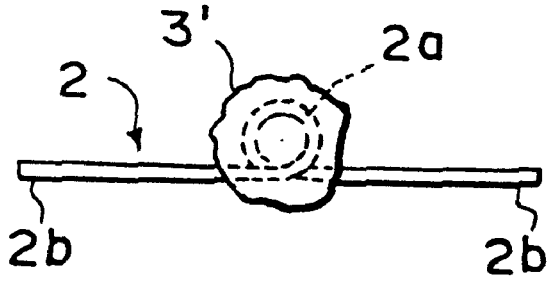
Figure 1C:
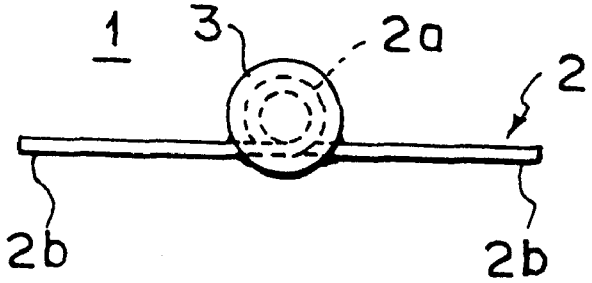
Figure 2A:
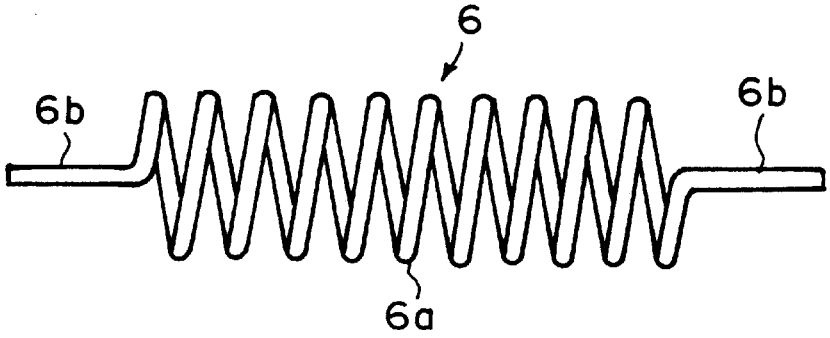
FIGS. 2A, 2B, and 2C are front views showing steps for producing a flame reaction member for burners in a different embodiment of the process in accordance with the present invention.
Figure 2B:
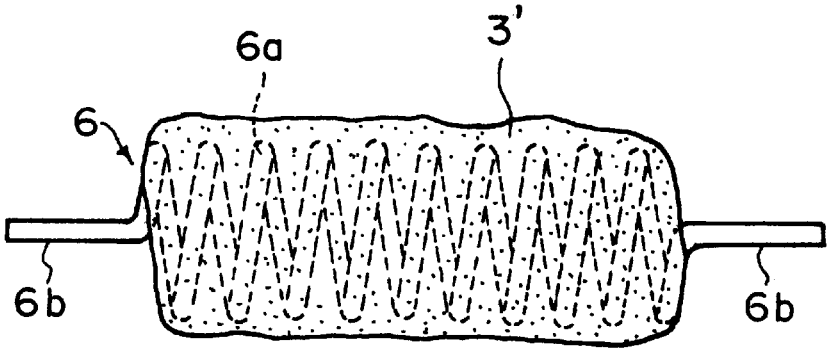
Figure 2C:
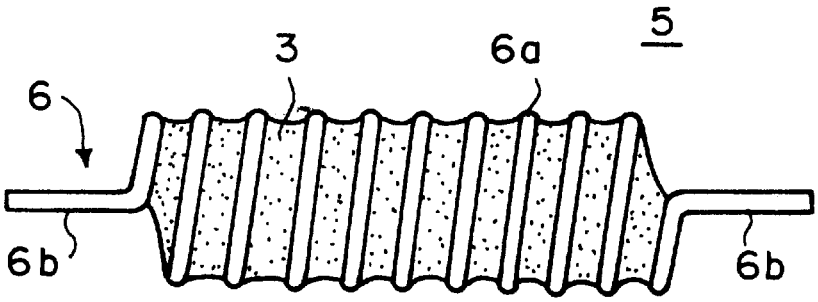
Figure 3:
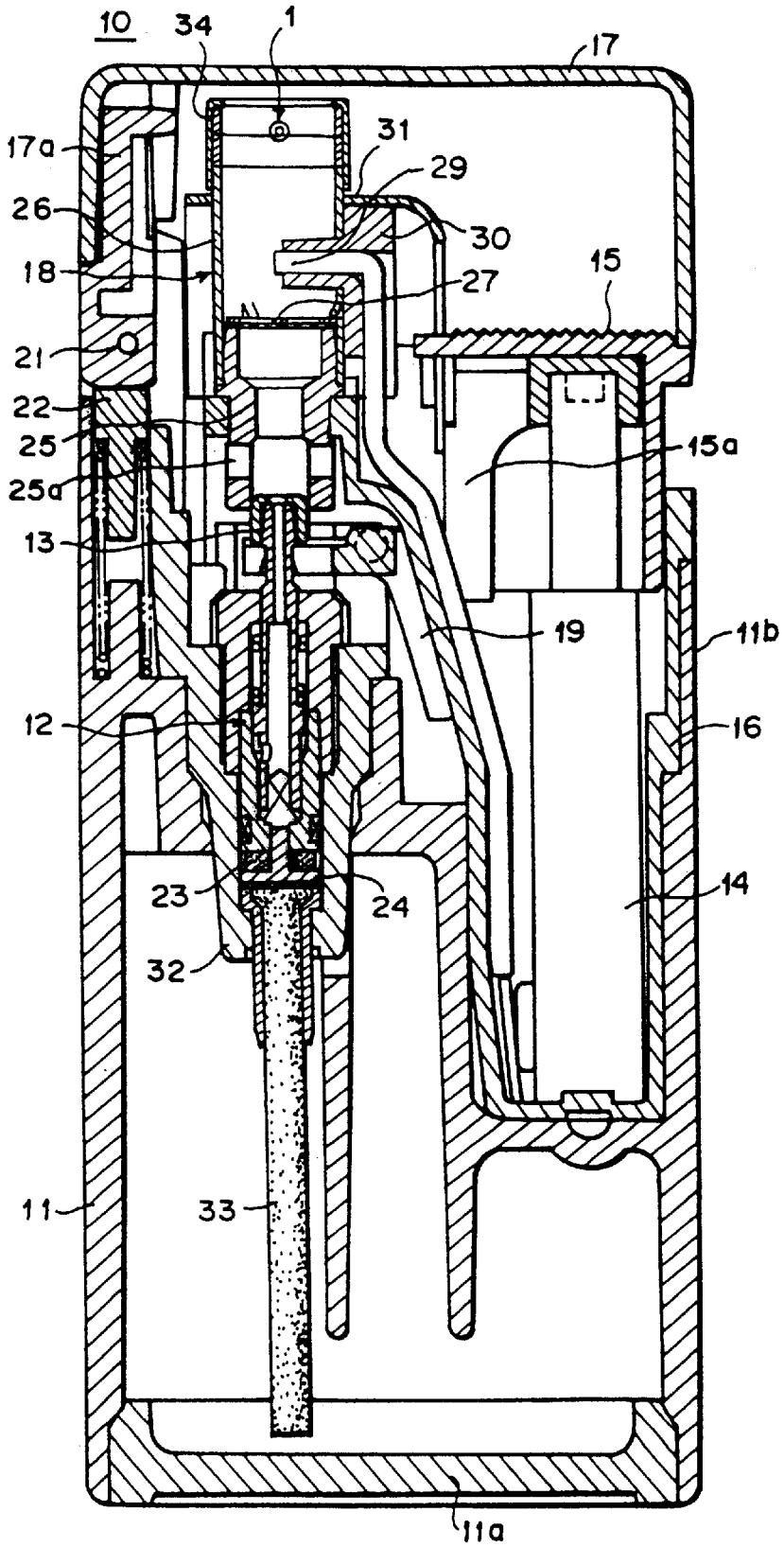
FIG. 3 is a vertical sectional view showing a gas lighter, which is provided with a flame reaction member for burners.
Figure 4:
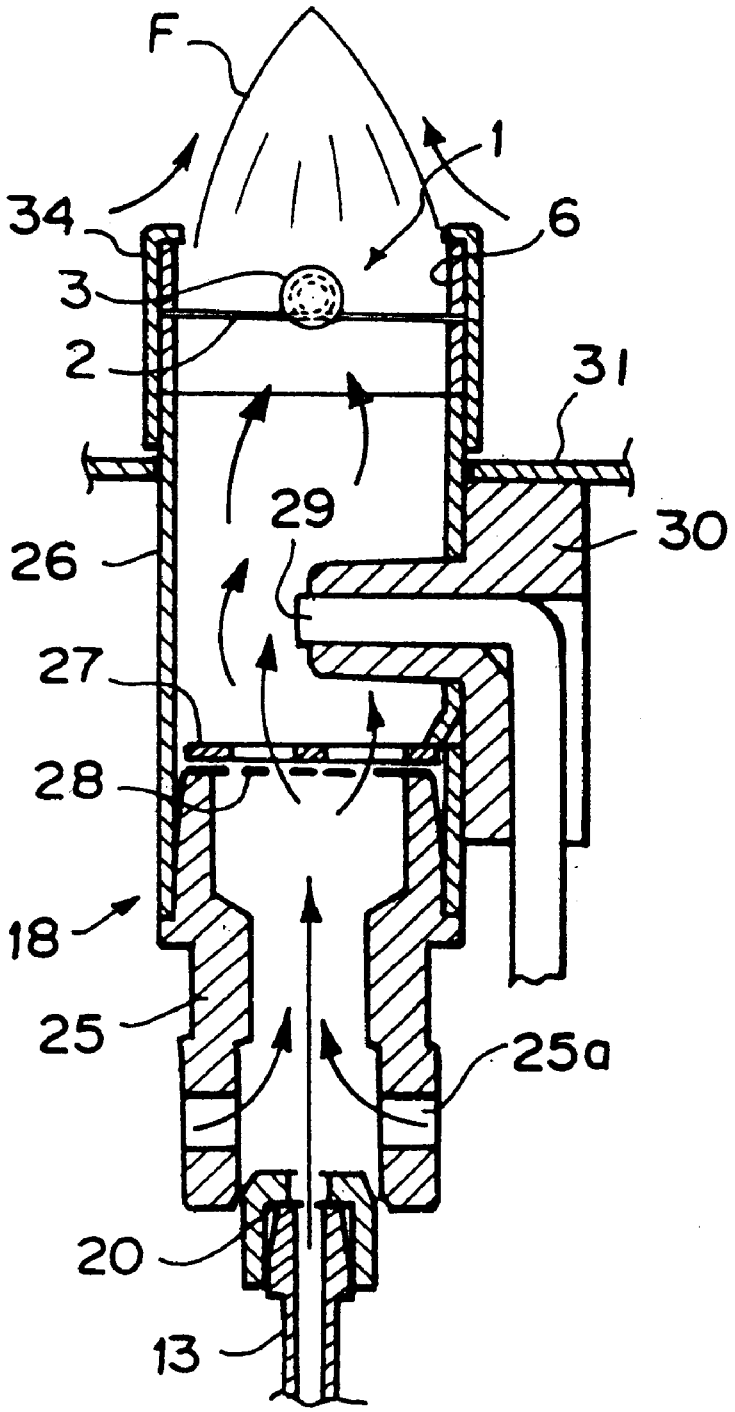
FIG. 4 is an enlarged sectional view showing a major part of the gas lighter shown in FIG. 3, FIGS. 5A through 5F are diagrams showing the relationships between blending proportions in ternary materials containing sodium salts or sodium oxide and vitrification ranges of the ternary materials.

Embodiments of the process for producing a flame reaction member for burners, which flame reaction member is to be installed in a gas lighter serving as gas combustion appliances, will be described hereinbelow. FIGS. 1A, 1B, and 1C are front views showing steps for producing a flame reaction member for burners in an embodiment of the process in accordance with the present invention. FIGS. 2A, 2B, and 2C are front views showing steps for producing a flame reaction member for burners in a different embodiment of the process in accordance with the present invention. FIG. 3 is a vertical sectional view showing a gas lighter, which is provided with a flame reaction member for burners. FIG. 4 is an enlarged sectional view showing a major part of the gas lighter shown in FIG. 3.

As illustrated in FIG. 1C, a flame reaction member 1 comprises a substrate 2, which is constituted of a heat-resistant material, such as a nickel-chrome alloy wire (hereinafter referred to as the nichrome wire), and a glass sphere-shaped flame reaction material 3, which is constituted of a glass compound having been fusion bonded to the substrate 2.

As illustrated in FIG. 1A, the substrate 2 has a support portion 2*a*, which is formed by winding the middle portion of the nichrome wire two turns in a loop-like form, and linear fitting portions 2*b*, 2*b*, which extend from the opposite ends of the support portion 2*a*. By way of example, the diameter of the nichrome wire is 0.15 mm, and the loop diameter (the loop outer diameter) of the support portion 2*a* is approximately 1.0 mm.

In a different embodiment, as illustrated in FIG. 2C, a flame reaction member 5 comprises a coil-like substrate 6, which is constituted of a heat-resistant material, such as a nichrome wire, and a flame reaction material 3, which is constituted of a glass compound having been fusion bonded to the substrate 6.

As illustrated in FIG. 2A, the substrate 6 has a support portion 6*a*, which is formed by winding the middle portion of the nichrome wire a plurality of turns in a coil-like form, and linear fitting portions 6*b*, 6*b*, which extend from the opposite ends of the support portion 6*a*.

By way of example, the diameter of the nichrome wire is 0.15 mm. Also, the support portion 6*a* is formed such that the coil inner diameter may be 0.8 mm, the coil outer diameter may be 1.1 mm, the length may be 6 mm, the number of turns may be 20, and the pitch may be 0.3 mm.

The flame reaction member 3 is fusion bonded to the support portion 2*a* of the substrate 2 or the support portion 6*a* of the substrate 6. Specifically, a mixed material is prepared from a metal salt capable of undergoing a flame reaction, e.g. a carbonate $Na_2CO_3$, a metal oxide, which is capable of being mixed and fused together with the aforesaid metal salt and vitrified, e.g. silica $SiO_2$, and a low-melting-temperature glass material (hereinbelow referred to as a glass frit). The thus obtained mixed material is then mixed with water and a binder, and a viscous liquid-like flame reaction material 3' is thereby obtained. As illustrated in FIG. 1B or FIG. 2B, the viscous liquid-like flame reaction material 3' is applied onto the support portion 2*a* of the substrate 2 or the support portion 6*a* of the substrate 6 and heated to a temperature (e.g. 900° C.) not lower than the melting point of the viscous liquid-like flame reaction material 3'. As illustrated in FIG. 1C or FIG. 2C, the flame reaction material 3, which is constituted of the resulting molten compound, is fusion bonded to the support portion 2*a* or 6*a*.

Figures 5A, 5B, 5C, 5D, 5E, 5F:
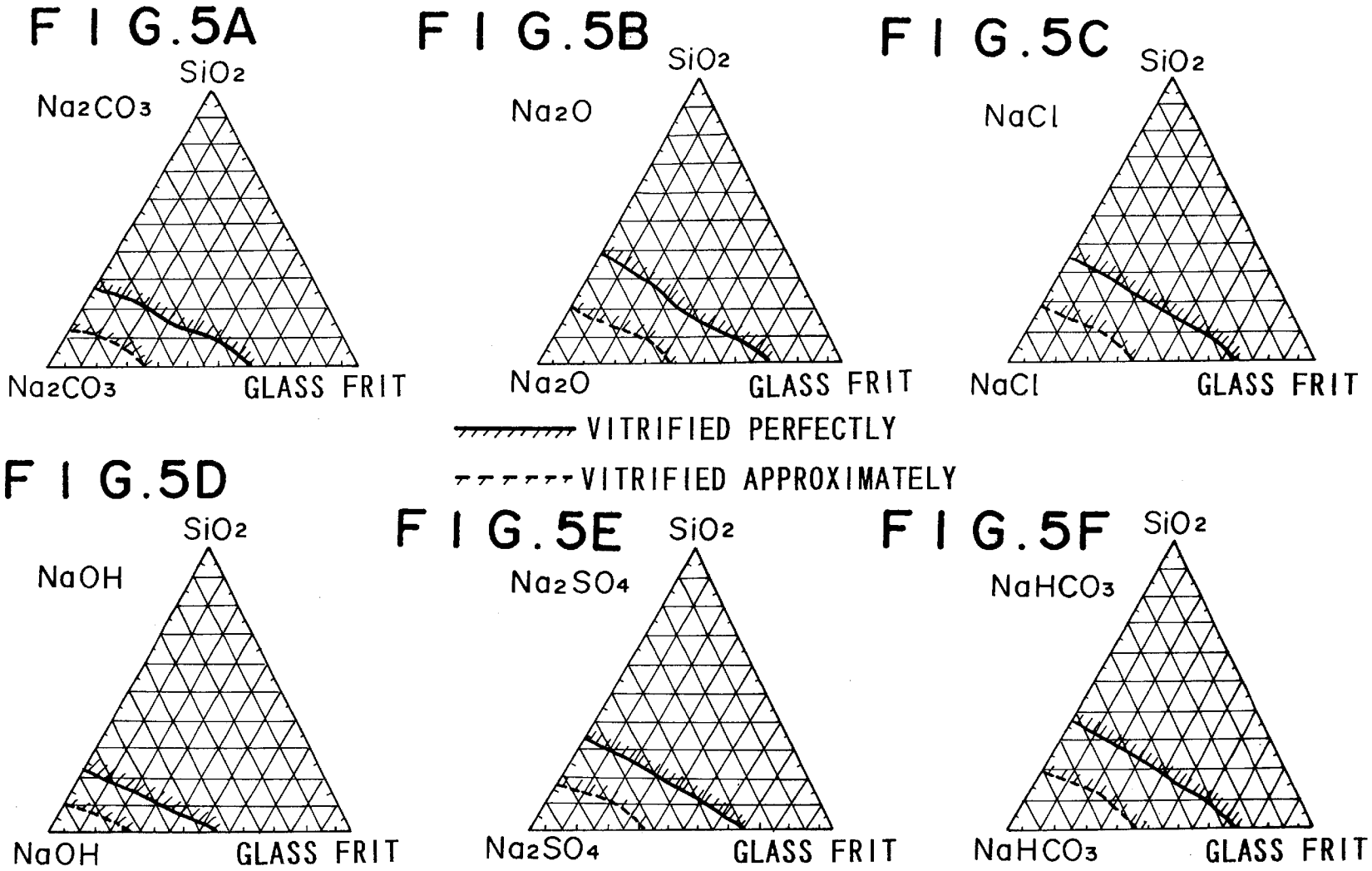
Figures 6A, 6B, 6C, 6D, 6E, 6F:
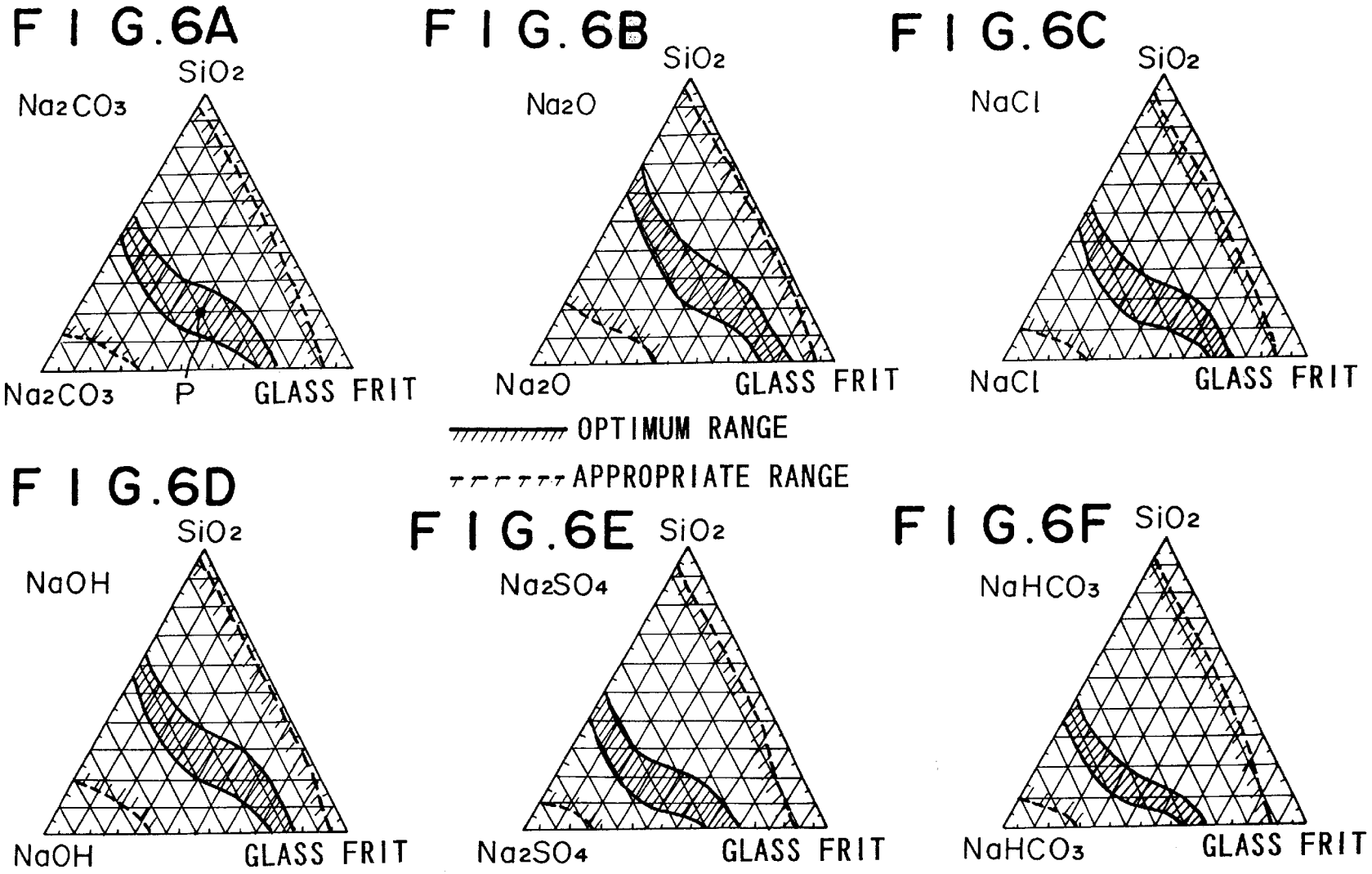
FIGS. 6A through 6F are diagrams showing overall appropriate blending ranges and overall optimum blending ranges in the ternary materials containing sodium salts or sodium oxide.
Figures 7A, 7B, 7C, 7D, 7E:
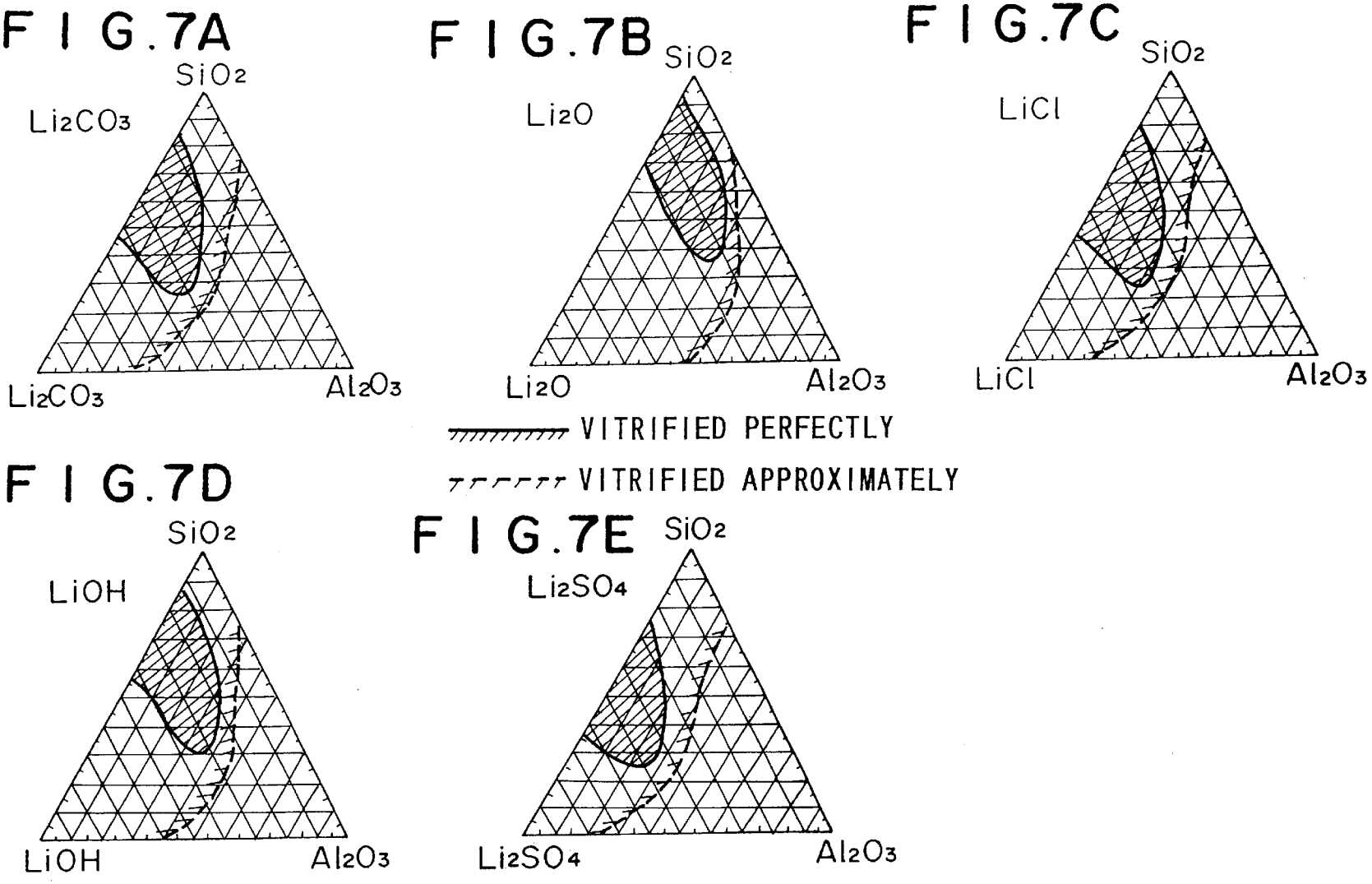
FIGS. 7A through 7E are diagrams showing the relationships between blending proportions in ternary materials containing lithium salts or lithium oxide and vitrification ranges of the ternary materials.
Figures 8A, 8B, 8C, 8D, 8E:
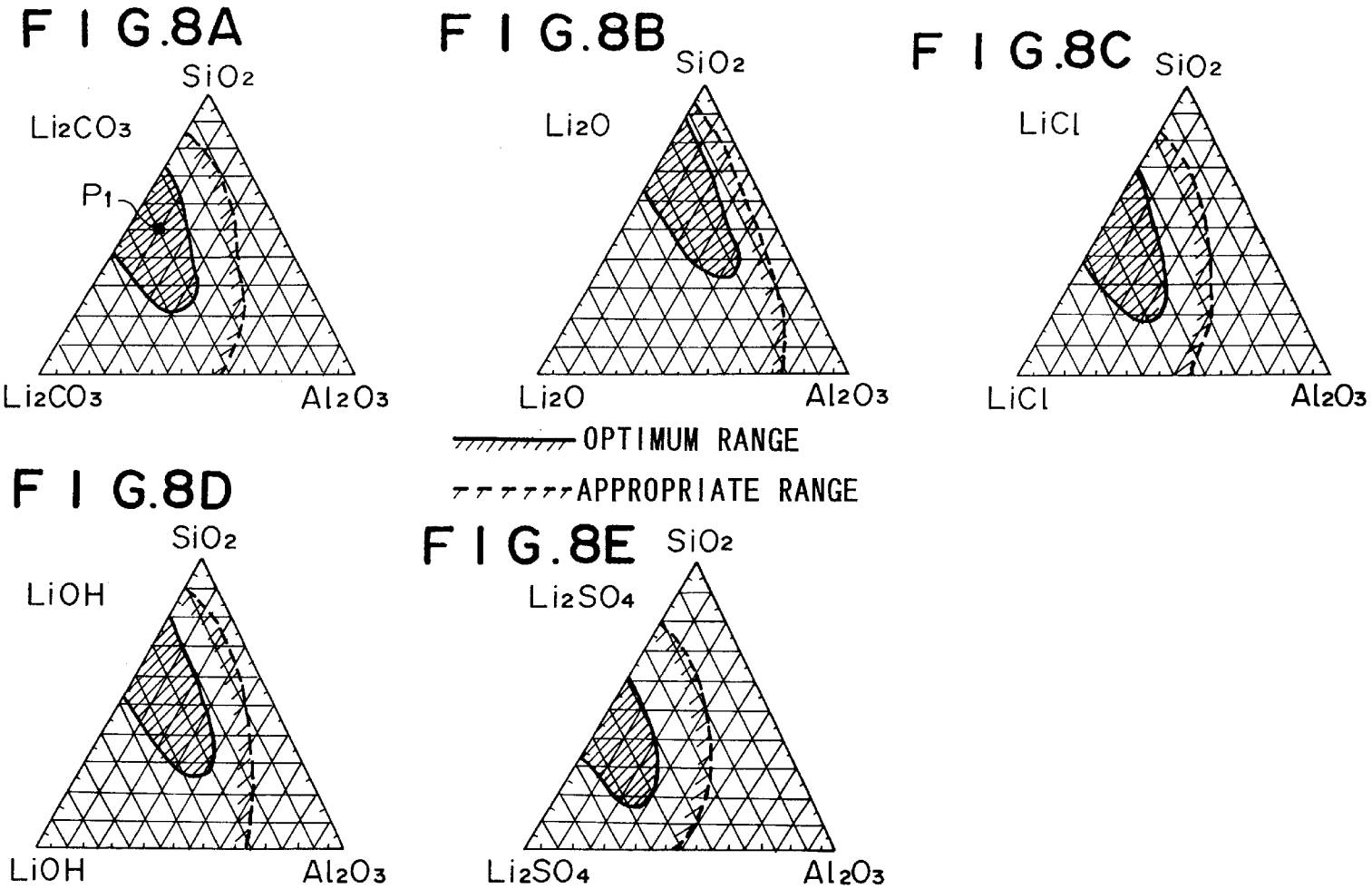
FIGS. 8A through 8E are diagrams showing overall appropriate blending ranges and overall optimum blending ranges in the ternary materials containing lithium salts or lithium oxide.
Figure 9A:
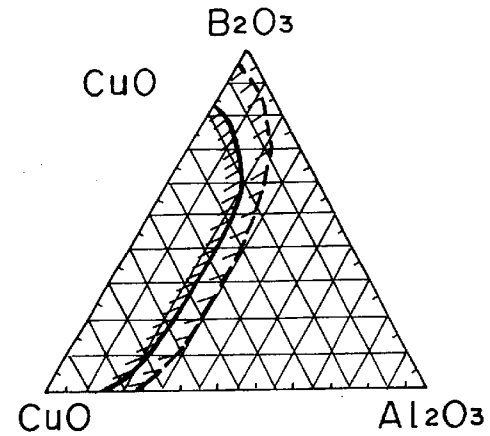
FIGS. 9A through 9D are diagrams showing the relationships between blending proportions in ternary materials containing copper salts or oxides and vitrification ranges of the ternary materials.
Figure 9B:
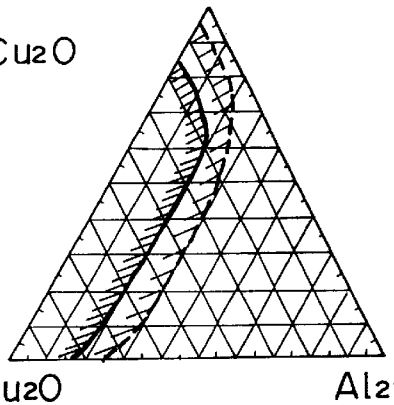
Figure 9C:
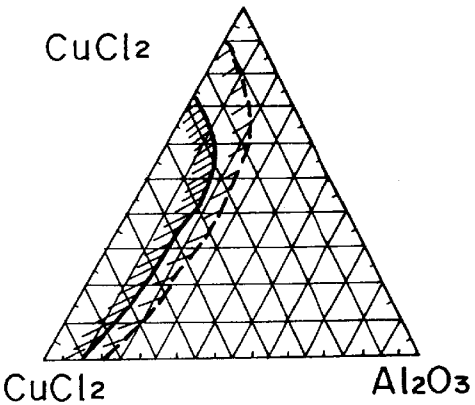
Figure 9D:
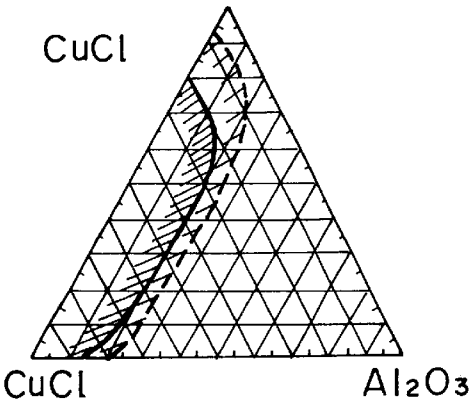
Figure 10A:
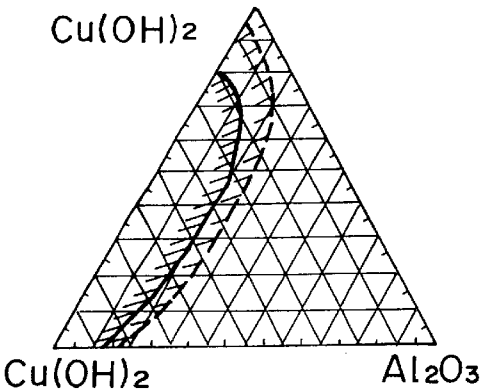
FIGS. 10A through 10E are diagrams showing the relationships between blending proportions in ternary materials containing other copper salts and vitrification ranges of the ternary materials.
Figure 10B:
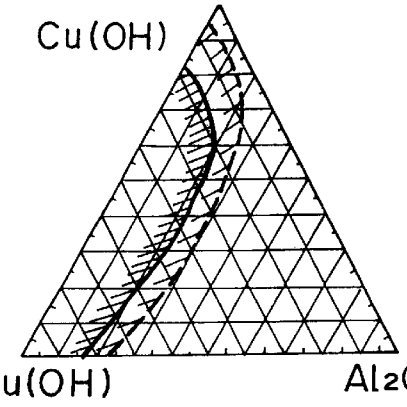
Figure 10C:
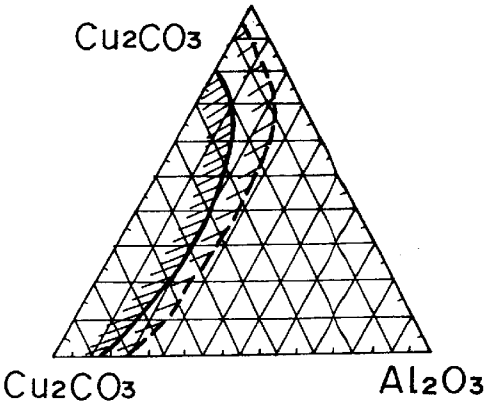
Figure 10D:
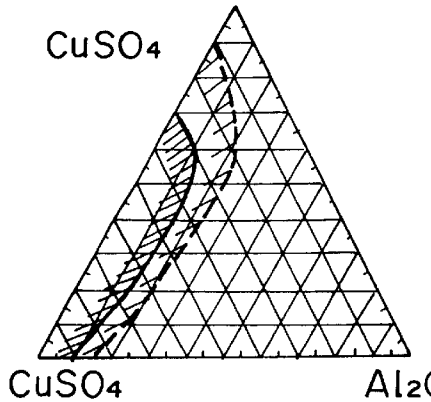
Figure 10E:
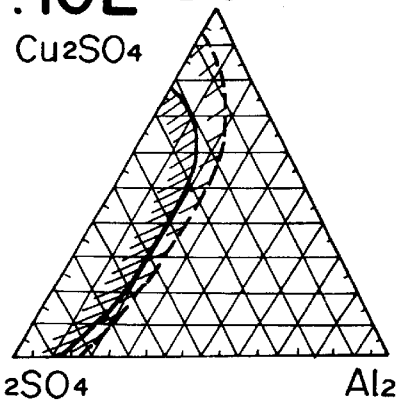
Figures 11A, 11B, 11C, 11D:
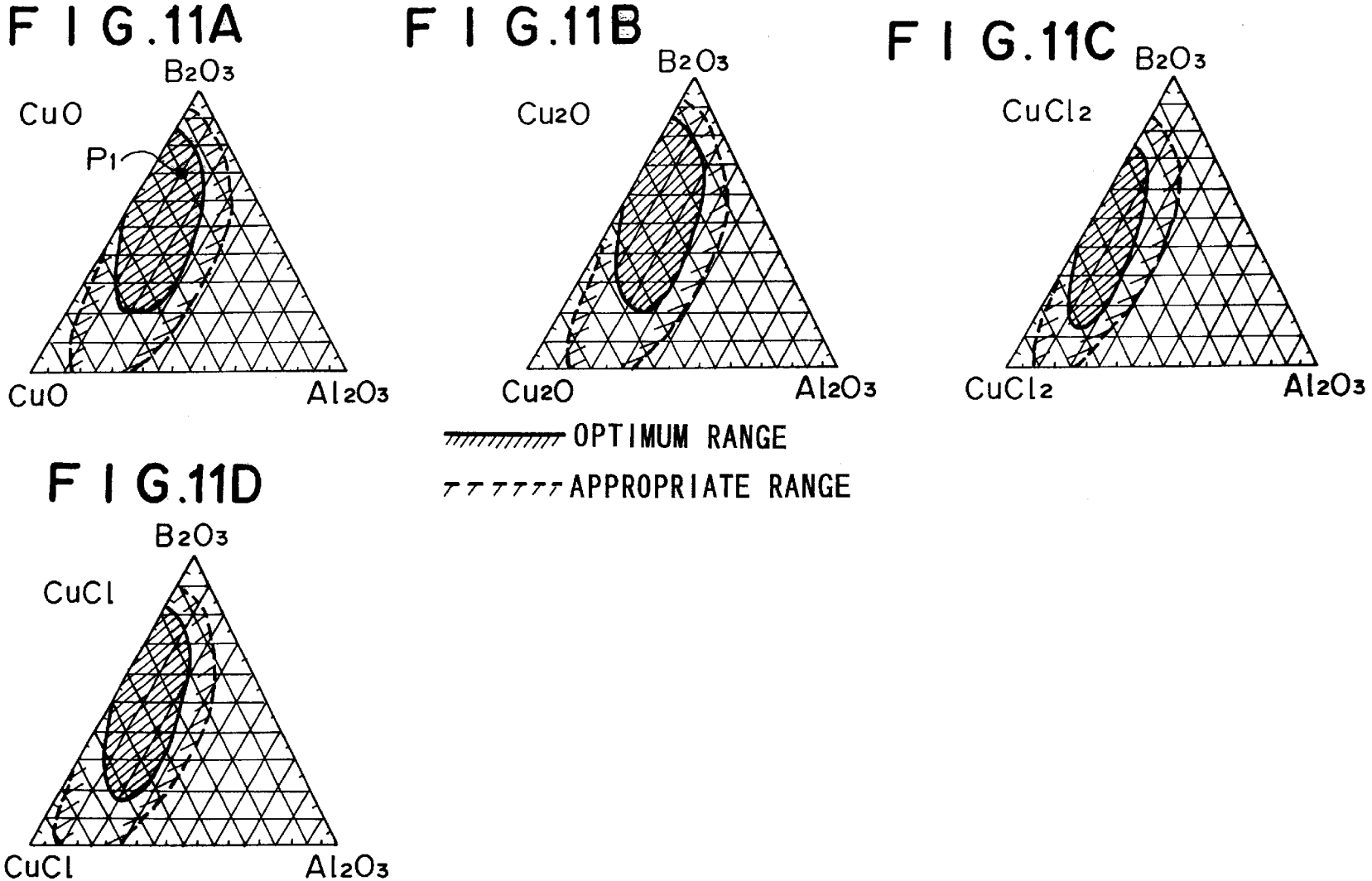
FIGS. 11A through 11D are diagrams showing overall appropriate blending ranges and overall optimum blending ranges in the ternary materials containing copper salts or oxides.
Figure 12A:
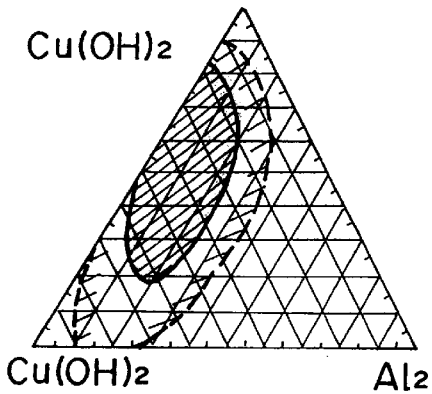
FIGS. 12A through 12E are diagrams showing overall appropriate blending ranges and overall optimum blending ranges in the ternary materials containing other copper salts or oxides.
Figure 12B:
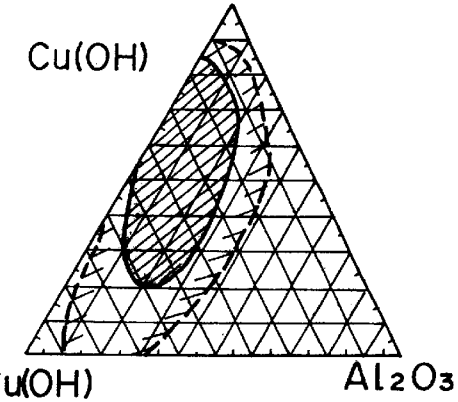
Figure 12C:
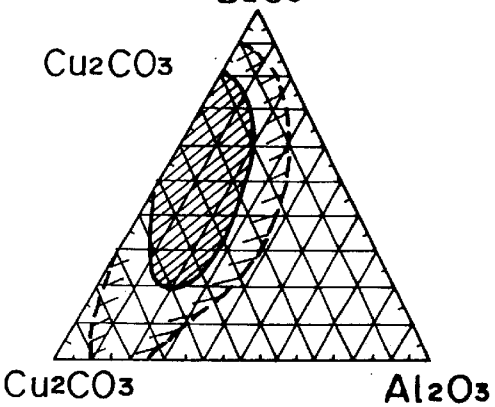
Figure 12D:
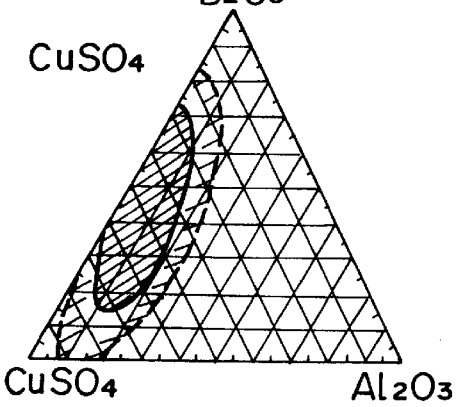
Figure 12E:
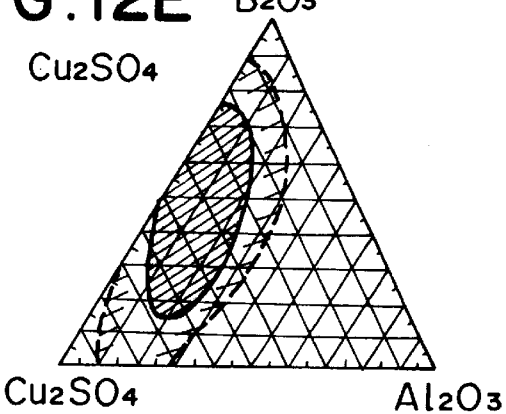

FIGS. 5A through 5F are diagrams showing the vitrification ranges of the flame reaction materials 3, which contain various sodium salts described above or sodium oxide. FIG. 5A shows the cases wherein an $Na_2CO_3$—$SiO_2$-glass frit ternary material is employed as the starting material for the flame reaction material. At the time of vitrification, the diagram of FIG. 5A becomes identical with the diagram for an $Na_2O$—$SiO_2$-glass frit ternary material shown in FIG. 5B. Also, FIGS. 5C, 5D, 5E, and 5F show the cases wherein ternary materials containing other sodium salts are employed as the compositions of the starting materials. At the time of vitrification, due to the thermal decomposition, the diagrams of FIGS. 5C, 5D, 5E, and 5F become identical with the diagram for the $Na_2O$—$SiO_2$-glass frit ternary material shown in FIG. 5B.

In FIGS. 5A through 5F and those that follow, which show the blending proportions, the blending proportions of the substance indicated at the vertex are plotted such that the opposite side may represent 0%, and the vertex may represent 100%. The lines parallel to the opposite side represents the graduations at intervals of 10%. The hatched inner side represents an appropriate range. In FIGS. 5A through 5F and those that follow, the glass frit is the one having the composition of No. 2 shown in Table 1 below.

FIGS. 6A through 6F are diagrams showing overall appropriate blending ranges and overall optimum blending ranges in the ternary materials containing sodium salts or sodium oxide, which ranges are found by taking characteristics other than the vitrification characteristics into consideration. In finding the overall appropriate blending ranges and overall optimum blending ranges, the flame reaction member 1 or 5 described above was fitted to a burner section shown in FIG. 4, which will be described later, and was incorporated in a lighter for smoker's requisites. Also, as the necessary characteristics before and after the incorporation, the compression strength of the flame reaction material 3, the color forming characteristics during the heating in the burner, the durability, the color formation durability during continuous lighting, and the like, were investigated. A judgment was made from the thus obtained results as a whole.

FIGS. 7A through 7E are diagrams showing the relationships between blending proportions in ternary materials containing salts of lithium Li, which is capable of undergoing a red flame reaction, and a ternary material containing an oxide $Li_2O$, which is formed from the decomposition of the lithium salts, and vitrification ranges of the ternary materials. FIGS. 8A through 8E are diagrams showing overall appropriate blending ranges and overall optimum blending ranges in the ternary materials containing lithium salts or lithium oxide.

FIGS. 9A through 9D and FIGS. 10A through 10E are diagrams showing the relationships between blending proportions in ternary materials containing salts of copper Cu, which is capable of undergoing a green flame reaction, and ternary materials containing oxides CuO and $Cu_2O$, which are formed from the decomposition of the copper salts, and vitrification ranges of the ternary materials. FIGS. 11A through 11D and FIGS. 12A through 12E are diagrams showing overall appropriate blending ranges and overall optimum blending ranges in the ternary materials containing copper salts or oxides. At the time of vitrification, CuO is ultimately vitrified as $Cu_2O$. In both cases of Cuo and $Cu_2O$, as the flame reaction, they are reduced into copper atoms, which form a green color.

The aforesaid glass frit (the low-melting-temperature glass material) is blended for reinforcement of the fusion bonding to the substrate. The glass composition of the glass frit is selected such that it may not contain a constituent which thermally decomposes in the temperature increasing step. Also, the glass frit is selected from powdered glass frits for adhesion, and the like, which have a low melting point and do not adversely affect the flame reaction. Examples of the compositions of the glass frits are shown in Table 1 shown below.

TABLE 1

| Glass Frit | Melting Point | Composition | | | | | |
|---|---|---|---|---|---|---|---|
| No. 1 | 625° C. | $SiO_2$ 15.0% | $Al_2O_3$ 5.0% | $B_2O_3$ 20.0% | PbO 60.0% | | |
| No. 2 | 750° C. | $SiO_2$ 10.0% | ZnO 65.0% | $B_2O_3$ 25.0% | | | |
| No. 3 | 1240° C. | $SiO_2$ 80.9% | $Al_2O_3$ 2.3% | $B_2O_3$ 12.7% | $Na_2O$ 4.0% | $K_2O$ 0.04% | $Fe_2O_3$ 0.03% |

The glass frits listed in Table 1 above by themselves undergo slight flame reactions. The No. 1 glass frit forms a pale violet flame color, the No. 2 glass frit forms a pale orange flame color, and the No. 3 glass frit forms an orange flame color. The glass frit is mixed with the flame reaction material 3 such that the flame color formed by the glass frit may not obstruct the desired flame color formed by the flame reaction agent. In this manner, the strength of the flame reaction material 3 is enhanced, the practical performance of the flame reaction member is enhanced. Glass frits having compositions different from those shown above may also be used.

A glass frit having a comparatively high melting point, such as the No. 3 glass frit, has the characteristics such that it can firmly fusion bond the flame reaction material 3 to the substrate 2.

The structure of the gas lighter, in which the flame reaction member 1 is employed, will be described hereinbelow with reference to FIGS. 3 and 4.

A gas lighter 10 is provided with a tank body 11, which stores a fuel gas and is located at the lower part of the gas lighter 10. The tank body 11 is made by molding a synthetic resin. A bottom cover 11*a* is fitted to the bottom portion of the tank body 11, and a high-pressure fuel gas, such as butane gas, is stored in the tank body 11. A side wall 11*b* is integrally molded at the upper peripheral surface of the tank body 11. A valve mechanism 12, which is provided with a nozzle 13 for jetting the fuel gas, is accommodated in a valve housing 32. The valve housing 32, in which the valve mechanism 12 is accommodated, is fitted into an upper end of the tank body 11. A combustion cylinder 18, in which the fuel gas having been jetted from the nozzle 13 is burned, is located above the nozzle 13. The combustion cylinder 18 is of the internal combustion type, in which primary air is mixed into the fuel gas such that the fuel gas may burn perfectly at high temperatures. As a result, a colorless (or a pale blue) combustion flame is produced, and good effects of the flame reaction can be obtained.

A piezo-electric unit 14 is located along a side of the valve mechanism 12. An operation member 15 is located at an upper end of the piezo-electric unit 14. The operation member 15 operates the valve mechanism 12 in order to jet the fuel gas from the nozzle 13 and operates the piezo-electric unit 14 in order to light the fuel gas having been jetted from the nozzle 13. The piezo-electric unit 14, the operation member 15, and the combustion cylinder 18 are supported by an inner housing 16 and coupled with the tank body 11.

A rising-falling type of cover 17 opens and closes the upper part of the combustion cylinder 18 and the area above the operation member 15. A fulcrum member 17*a* is secured to the cover 17 and pivotably supported on the tank body 11 by a pin 21. A push-up member 22 is urged upwardly such that it may come into contact with either one of two surfaces of the fulcrum member 17*a* in order to hold the cover 17 at the open position or the closed position.

In the valve mechanism 12, a fuel gas flow path is opened by an upward movement of the nozzle 13, and the fuel gas is jetted from a top end of the nozzle 13. An L-shaped actuating lever 19 is located such that its one end may be engaged with the nozzle 13. The actuating lever 19 is pivotably supported by a fulcrum located at an intermediate portion of the actuating lever 19. An operating portion at the other end of the actuating lever 19 comes into contact with a lever push piece 15*a* of the operation member 15 and is thereby rotated. In this manner, the actuating lever 19 actuates and ceases the jetting of the fuel gas from the nozzle 13. A nozzle plate 20, which is shown in FIG. 4 and has a hole having a predetermined diameter (for example, 50 $\mu$m), is located at the top end of the nozzle 13. The nozzle plate 20 is fitted into the bottom of the combustion cylinder 18, and the fuel gas is quickly jetted into the combustion cylinder 18.

Also, the valve mechanism 12 is provided with a gas flow rate adjusting filter 23, which adjusts such that the amount of the fuel gas jetted may be kept approximately at a predetermined value even if the temperature changes. The gas flow rate adjusting filter 23 is located in a compressed state at the bottom of the valve mechanism 12 by a nail-like stator 24. The liquefied fuel gas moves through a porous core 33 from the tank. The liquefied fuel gas, which has moved through the porous core 33, flows radially from the outer periphery of the gas flow rate adjusting filter 23 towards the center of the gas flow rate adjusting filter 23 and is thus vaporized. The gas flow rate adjusting filter 23 is constituted of a micro-cell polymer foam comprising open cells, which communicate with one another through micro-pores at points of contact and thus constitute a gas flow path, and closed cells, which expand or contract with a change in temperature and thereby compress or enlarge the gas flow path. The gas flow rate adjusting filter 23 has the effects of automatically adjusting the gas flow rate with respect to a change in temperature.

As illustrated also in FIG. 4, the combustion cylinder 18 comprises a base member 25, which is located at the base portion of the combustion cylinder 18, and a combustion pipe 26, which is secured to the base member 25 and extends upwardly. The base member 25 has a gas flow path, which extends through the center portion of the base member 25. The bottom end of the base member 25 is fitted onto the top end of the nozzle 13. A radially-extending primary air hole 25*a* opens on opposite sides of the base member 25 and at a position above the bottom end of the base member 25.

An eddy flow plate 27 and a metal mesh member 28 are placed on the top end of the base member 25. The eddy flow plate 27 is constituted of a metal disk having apertures. The eddy flow plate 27 produces a turbulent flow in of the fuel gas flow and thereby enhances the mixing of the fuel gas and the primary air. The metal mesh member 28 is constituted of circular wire gauze and prevents a back flow of the flame.

The operation member 15 is supported by being associated with the piezo-electric unit 14 such that the operation member 15 can slide downwardly. An electrical discharge electrode 29, which is connected to the piezo-electric unit 14, is located along a side of the operation member 15. The electrical discharge electrode 29 is held by an electrode holder 30, which extends through the side wall of the combustion pipe 26, such that an end of the electrical discharge electrode 29 may stand facing the area inside of the combustion pipe 26.

An outer peripheral portion of the base member 25 of the combustion cylinder 18, which portion is located above the primary air hole 25*a*, is engaged with and supported by the inner housing 16. The base member 25 is thus supported together with the combustion pipe 26. The combustion cylinder 18 is associated with the electrical discharge electrode 29 and the electrode holder 30, and a cover 31 is located on the outward side of the electrode holder 30. The combustion cylinder 18 is secured in this manner. These members are assembled together with the piezo-electric unit 14 and the operation member 15 by the inner housing 16. The assembly is assembled to the tank body 11. Therefore, the assembling work can be kept simple.

The flame reaction member 1 is located in the vicinity of the top end of the combustion pipe 26 of the combustion cylinder 18. The fitting portions 2*b*, 2*b* extending from the opposite ends of the support portion 2*a* of the flame reaction member 1 are secured to an annular member 6, which has the same shape as the shape of the combustion pipe 26, and the catalyst member 1 is located radially in the annular member 6. The annular member 6 is located at the top end of the combustion pipe 26, and a cap 34 is fitted onto the outer periphery of the annular member 6 and the outer periphery of the combustion pipe 26. In this manner, the flame reaction member 1 is located at the opening of the fire outlet at the top end of the combustion pipe 26.

In the gas lighter 10 constructed in the manner described above, when the cover 17 is opened and the operation member 15 is pushed down, the lever push piece 15*a* of the operation member 15 causes the actuating lever 19 to rotate. The nozzle 13 is thus moved up by the actuating lever 19. As a result, the fuel gas is jetted from the nozzle 13. The primary air is introduced from the primary air hole 25*a*, which opens through the side wall of the base member 25 of the combustion cylinder 18, by the effects of a negative pressure, which is produced by the flow velocity and the flow rate of the fuel gas being jetted from the nozzle 13. The primary air having been introduced from the primary air hole 5 is mixed with the jetted fuel gas. The primary air and the fuel gas pass through the metal mesh member 28 for preventing a back flow of the flame and thereafter stirred and mixed together by the eddy flow plate 27. The resulting mixed gas flows upwardly in the combustion pipe 26.

When the operation member 15 is pushed down even further, the piezo-electric unit 14 is actuated by the operation member 15. In this manner, a high voltage for electrical discharge is applied to the electrical discharge electrode 29, discharge is caused to occur, and the mixed gas is lighted. As a result, the air-mixed gas burns, moves upwardly, passes through the flame reaction member 1, and goes from the combustion cylinder 18 to the exterior. The mixed gas moving upwardly from the combustion cylinder 18 is mixed with secondary air at the top end of the combustion cylinder and undergoes perfect combustion.

At this time, due to the relationship between the a rate of combustion of the mixed gas and the upward flow rate of the mixed gas, the combustion of the mixed gas occurs such that, though the mixed gas is burned in the region inward from the top end of the combustion cylinder 18, the mixed gas is present together with an unburned gas flow in this region. Also, though the temperature of the region in the vicinity of the flame reaction member 1 rises due to the heat of combustion, this region becomes an imperfect combustion region, which has a reducing atmosphere. When the mixed gas arrives at the top end of the combustion cylinder 18, the combustion gas flow is diffused to the external air and, at the same time, the secondary air is mixed into the mixed gas. Therefore, at this instant, the mixed gas is burned perfectly, the temperature rises sharply from the temperature of the region inward from the top end of the combustion cylinder 18, and the combustion is continued.

The flame reaction material 3 of the flame reaction member 1 comprises the glass compound, which contains the material having a low melting point falling a within the range of approximately 600° C. to approximately 1,200° C. Therefore, when the gas is lighted in the gas lighter 10, the flame reaction material 3 becomes molten as the temperature rises. The action of the molecules of the flame reaction material 3 becomes active as the temperature rises, the flame reaction metal salt is reduced by the reducing atmosphere of the gas flame, and the flame reaction metal is thus dissociated and scattered. The scattered metal atoms are moved upwardly together with the gas flow, carried into the perfect combustion flame, and heated to a high temperature in the perfect combustion flame. As a result, the flame reaction metal atoms are excited to produce the line spectrum having a wavelength inherent to the flame reaction metal and thereby forms a color. In this manner, the gas flame is colored.

From the viewpoint of prevention of breakage, or the like, the flame reaction member 1 should preferably be located at a position more inward from the top end of the combustion cylinder 18. However,the flame reaction member 1 should be located at a position in the region, which becomes the reducing atmosphere and in which the temperature rise is quick, in accordance with the temperature distribution of the gas flame.

The present invention will further be illustrated by the following nonlimitative examples.

EXAMPLE 1

As an orange-yellow color forming material, $Na_2CO_3$ was selected and mixed with $SiO_2$ and a glass frit ($SiO_2$: 10%, ZnO: 65%, $B_2O_3$: 25%), and a material for an orange-yellow flame reaction material was thereby obtained. Blending proportions were set in accordance with FIG. 6A. Specifically, 0.4 g of $Na_2CO_3$, 0.2 g of $SiO_2$, and 0.4 g of the glass frit were mixed together in a mortar, and the composition for the flame reaction material was thereby obtained.

The $Na_2CO_3$—$Sio_2$-glass frit ternary material was then mixed with 0.5 g of a laundry sizing agent (containing a polyvinyl alcohol), which served as a binder, and 0.1 cc of water, and a viscous liquid-like flame reaction material was thereby obtained. Approximately 20 mg of the viscous liquid-like flame reaction material was coated onto a nichrome wire coil serving as a substrate (wire diameter: 0.15 mm, coil inner diameter: 0.8 mm, coil outer diameter: 1.1 mm, length: 6 mm, number of turns: 20, pitch: 0.3 mm). The temperature of the coated viscous liquid-like flame reaction material was increased from normal temperatures to 900° C. slowly over a period of 10 minutes. The temperature was kept at 900° C. for 10 minutes in order to carry out fusion bonding. In this manner, a flame reaction member was produced.

In the temperature increasing step, thermal decomposition of $Na_2CO_3$ in the composition occurred, and $CO_2$ gas was generated. Since the rate of temperature increase was set to be slow as described above, the rate of generation of the decomposition gas became low, and the flame reaction material could be prevented from being scattered by the decomposition gas. Therefore, a predetermined amount of the flame reaction material could be appropriately carried on the substrate. However, in cases where the rate of temperature increase was set to be high and the flame reaction material was heated quickly, $C\mathbf{0}_2$ gas was generated violently due to quick thermal decomposition of $Na_2CO_3$, and foaming occurred in the flame reaction material. As a result, the flame reaction material, which was being fixed weakly, was scattered, and the fusion bonding and the carrying of the flame reaction material to the substrate could not be carried out sufficiently.

EXAMPLE 2

As an orange-yellow color forming material, NaCl was selected and mixed with $SiO_2$ and a glass frit ($SiO_2$: 10% ZnO: 65%, $B_2O_3$: 25%), and a material for an orange-yellow flame reaction material was thereby obtained. Blending proportions were set in accordance with FIG. 6C. Specifically, 0.4 g of NaCl, 0.2 g of $SiO_2$, and 0.4 g of the glass frit were mixed together, and the composition for the flame reaction material was thereby obtained.

The NaCl—$SiO_2$-glass frit ternary material was then mixed with 0. 5 g of a laundry sizing agent, which served as a binder, and 0.1 cc of water, and a viscous liquid-like flame reaction material was thereby obtained. Approximately 20 mg of the viscous liquid-like flame reaction material was coated onto a nichrome wire coil serving as a substrate (wire diameter: 0.15 mm, coil inner diameter: 0.8 mm, coil outer diameter: 1.1 mm, length: 6 mm, number of turns: 20, pitch: 0.3 mm). The coated viscous liquid-like flame reaction material was introduced into a furnace at 900° C. and heated quickly. The composition was thereby fused. In this state, the flame reaction material was heated for 15 minutes. In this manner, a flame reaction member was produced.

In cases where NaCl was used in the composition, since its thermal decomposition temperature was not lower than the vitrification temperature, the scattering of the flame reaction material as in the example using $Na_2CO_3$ did not occur, and the flame reaction material could be carried appropriately on the substrate.

EXAMPLE 3

An $Na_2CO_3$—$SiO_2$-glass frit ternary material was prepared in the same manner as that in Example 1. The ternary material was heated at 900° C. for 15 minutes and subjected to thermal decomposition. In this manner, $CO_2$ gas was removed from the ternary material, and an $Na_2O$—$SiO_2$-glass frit ternary vitreous flame reaction material was obtained. The thus obtained ternary vitreous flame reaction material was ground, and the thus obtained ground material was mixed with a laundry sizing agent, which serves as a binder, and water. In this manner, a viscous liquid-like flame reaction material was obtained. The viscous liquid-like flame reaction material was coated onto a nichrome wire coil serving as a substrate in the same manner as that in Example 1. The coated viscous liquid-like flame reaction material was introduced into a furnace at 900° C. and heated for 15 minutes. In this manner, a flame reaction member was produced.

In this case, in the temperature increasing step, no gas generation occurred in the flame reaction material, except for the evaporation of water and burning-off of the laundry sizing agent. Therefore, the carrying of the flame reaction material on the substrate could be carried out appropriately.

EXAMPLE 4

As a red color forming material, $Li_2CO_3$ was selected and mixed with $SiO_2$ and $Al_2O_3$. The resulting mixture was further mixed with a glass frit. A material for a red flame reaction material was thereby obtained. Blending proportions were set in accordance with FIG. 8A. Specifically, 0.4 g of $Li_2CO_3$, 0.5 g of $SiO_2$, and 0.1 g of $Al_2O_3$ were used. Also, 0.4 g of the glass frit ($SiO_2$: 10%, ZnO: 65%, $B_2O_3$: 25%) was used. The composition for the flame reaction material was thereby obtained.

The composition was then mixed with 0.5 g of a laundry sizing agent, which served as a binder, and 0.1 cc of water, and a viscous liquid-like flame reaction material was thereby obtained. Approximately 20 mg of the viscous liquid-like flame reaction material was coated onto a nichrome wire coil serving as a substrate (wire diameter: 0.15 mm, coil inner diameter: 0.8 mm, coil outer diameter: 1.1 mm, length: 6 mm, number of turns: 20, pitch: 0.3 mm). The coated viscous liquid-like flame reaction material was introduced into a furnace at 900° C., and the temperature of the flame reaction material was increased. Also, the temperature was kept at 900° C. for 10 minutes. In this manner, a flame reaction member was produced.

In this example, since the thermal decomposition temperature of $Li_2CO_3$ was 1,500° C. and its melting point was 726° C., $Li_2CO_3$ contained in the flame reaction material was fused at an intermediate point in the temperature increasing step. When the flame reaction material was vitrified, $Li_2CO_3$ was mixed in the fused state in the flame reaction material. Therefore, the scattering of the flame reaction material did not occur, and the flame reaction material could be carried appropriately on the substrate.

In cases where LiCl is selected as a red color forming material, since its thermal decomposition temperature is high, even if the flame reaction material is heated quickly, the flame reaction material can be carried appropriately on the substrate.

What is claimed is:

1. A process for producing a flame reaction member for coloring a burner flame comprising the steps of:

i) heating and increasing a temperature of a raw material mixture which has a glass composition containing a salt or an oxide of a flame reaction metal which produces color in a flame to form an intermediate base material in which the salt or oxide of the said flame reaction metal has been thermally decomposed and which is in a temporary sintered state or a fused glass state, ii) grinding the said intermediate base material to produce a ground material, iii) mixing the said ground material together with a liquid and, optionally, a binder, to form a viscous flame reaction material, iv) applying the said viscous flame reaction material to a substrate, and v) heating the said viscous flame reaction material to a temperature which is not lower than a vitrification melting temperature of the said viscous flame reaction material to fuision bond the flame reaction material to the said substrate to produce a flame reaction member comprising a substrate having flame reaction material bonded to the substrate.

2. A process as defined in claim 1 wherein a low-melting-temperature glass material is added to the said ground material of the said intermediate base material.

3. A process as defined in claim 1 wherein a low-melting-temperature glass material is blended in the said raw material mixture.

4. A process for producing a flame reaction member for coloring a burner flame comprising the steps of:

i) mixing a raw material mixture which has a glass composition containing a salt or an oxide of a flame reaction metal which produces color in a flame together with a liquid and, optionally, a binder, to form a viscous flame reaction material, ii) applying the said viscous flame reaction material to a substrate, and iii) heating the said viscous flame reaction material to a temperature which is not lower than a vitrification melting temperature of the flame reaction material to fusion bond the flame reaction material to the said substrate to produce a flame reaction member comprising a substrate having flame reaction material bonded to the substrate, wherein the said raw material mixture contains a compound which has a thermal decomposition temperature not higher than the vitrification melting temperature of the flame reaction material, and a rate of temperature increase in the vicinity of the thermal decomposition temperature is set to be low enough to avoid scattering of the flame reaction material in the step of heating the said viscous flame reaction material.

5. A process as defined in claim 4 wherein a rate of temperature increase in the vicinity of an evaporation temperature of the said liquid or in the vicinity of a bum-off temperature of said binder is also set to be low enough to avoid scattering of the flame reaction material in the step of heating the said viscous flame reaction material.

6. A process as defined in claim 4 wherein the salt or the oxide of the said flame reaction metal has a thermal decomposition temperature which is not higher than the vitrification melting temperature of the flame reaction material and a melting point which is not lower than the vitrification melting temperature of the flame reaction material.

7. A process as defined in claim 4 wherein a low-melting-temperature glass material is blended in the said raw material mixture.

8. A process for producing a flame reaction member for coloring a burner flame comprising the steps of:

i) mixing a raw material mixture which has a glass composition containing a salt of a flame reaction metal which produces color in a flame together with a liquid and, optionally, a binder to form a viscous flame reaction material, ii) applying the said viscous flame reaction material to a substrate, and iii) heating the said viscous flame reaction material to a temperature which is not lower than a vitrification melting temperature of the flame reaction material to fusion bond the flame reaction material to the said substrate to produce a flame reaction member comprising a substrate having flame reaction material bonded to the substrate, wherein compounds which are contained in the said raw material mixture have a thermal decomposition temperature not lower than the vitrification melting temperature of the flame reaction material and are mixed in a fused state in the flame reaction material when the flame reaction material is fused and vitrified.

9. A process as defined in claim 8 wherein the salt of the said flame reaction metal has a thermal decomposition temperature which is not lower than the vitrification melting temperature of the flame reaction material and a melting point which is not higher than the vitrification melting temperature of the flame reaction material.

10. A process as defined in claim 8 wherein a low-melting-temperature glass material is blended in the said raw material mixture.

* * * * *